US007926896B2

(12) United States Patent
Chelvayohan et al.

(10) Patent No.: US 7,926,896 B2
(45) **Date of Patent: *Apr. 19, 2011**

(54) PRINT MEDIA DETECTION IN AN IMAGING APPARATUS

(75) Inventors: Mahesan Chelvayohan, Lexington, KY (US); Stephen Kelly Cunnagin, Lexington, KY (US); David Kyle Murray, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/034,841

(22) Filed: Feb. 21, 2008

(65) Prior Publication Data

US 2008/0143773 A1 Jun. 19, 2008

Related U.S. Application Data

(63) Continuation of application No. 10/955,226, filed on Sep. 30, 2004, now Pat. No. 7,401,878.

(51) Int. Cl.
*B41J 29/38* (2006.01)
*B41J 29/393* (2006.01)

(52) U.S. Cl. ..... 347/16; 347/14; 347/19

(58) Field of Classification Search ..... 347/14, 347/16, 19

See application file for complete search history.

(56) References Cited

U.S. PATENT DOCUMENTS

| | | | | |
|---|---|---|---|---|
| 4,031,386 | A | 6/1977 | Recker | |
| 4,737,645 | A | 4/1988 | Lahr | |
| 4,960,272 | A | 10/1990 | Wierszewski et al. | |
| 5,774,074 | A | 6/1998 | Cooper | |
| 5,929,789 | A | 7/1999 | Barbehenn | |
| 5,973,797 | A * | 10/1999 | Tanaka et al. | 358/488 |
| 6,140,662 | A | 10/2000 | Lim et al. | |
| 6,206,594 | B1 | 3/2001 | Elgee et al. | |
| 6,213,659 | B1 | 4/2001 | Elgee | |
| 6,367,793 | B1 | 4/2002 | O'Dea et al. | |
| 6,666,375 | B1 | 12/2003 | Harriman et al. | |
| 6,734,417 | B2 | 5/2004 | Vejtasa | |
| 7,401,878 | B2 * | 7/2008 | Chelvayohan et al. | 347/16 |
| 2004/0263550 | A1 | 12/2004 | Mitsuzawa | |
| 2005/0111015 | A1 * | 5/2005 | Tsujimoto | 358/1.9 |

* cited by examiner

*Primary Examiner* — Matthew Luu
*Assistant Examiner* — Jannelle M Lebron
(74) *Attorney, Agent, or Firm* — John Victor Pezdek; Justin M. Tromp

(57) ABSTRACT

An imaging apparatus includes a controller and a media detection device mechanically engaged with a stack of print media. The media detection device has a movable indicator having a surface with distinct reflectance characteristics. A reflectance sensor is communicatively coupled to the controller. The reflectance sensor reads a reflectance of the surface and outputs a signal to the controller indicative of at least one characteristic of the print media.

34 Claims, 7 Drawing Sheets

PRINT MEDIA DETECTION IN AN IMAGING APPARATUS

CROSS REFERENCE TO RELATED APPLICATIONS

This is a continuation of U.S. patent application Ser. No. 10/955,226, entitled "PRINT MEDIA DETECTION IN AN IMAGING APPARATUS", filed Sep. 30, 2004 now U.S. Pat. No. 7,401,878.

BACKGROUND OF THE INVENTION

1. Field of the Invention

The present invention relates to an imaging apparatus, and, more particularly, to the detection of print media size and/or print media stack height in an imaging apparatus.

2. Description of the Related Art

An imaging apparatus forms an image on a sheet of print media, such as for example, paper or a transparency, by applying ink or toner onto the sheet. Such an imaging apparatus, in the form of an electrophotographic (EP) printer, forms a latent image on a photoconductive surface, which in turn is developed and transferred to the sheet of print media. Such an imaging apparatus in the form of an ink jet printer typically forms an image on the sheet of print media by ejecting ink from at least one ink jet printhead to place ink dots on the sheet of print media. Such an ink jet printer typically includes a reciprocating printhead carrier that transports one or more ink jet printheads across the sheet of print media along a bi-directional scan path defining a print zone of the printer.

Such imaging apparatus typically provide a print media supply tray for receiving a stack of print media sheets, such as paper or transparency. It is desirable to know the exact size of the print media prior to printing with the imaging apparatus. In addition, it is desirable to know how much print media is available for printing. For example, a printing job may be delayed if an adequate amount of print media of a proper size is not available to complete the print job.

What is needed in the art is a media detection apparatus that facilitates the detection of print media size and/or print media stack height in an imaging apparatus.

SUMMARY OF THE INVENTION

The present invention provides a media detection apparatus that facilitates the detection of print media size and/or print media stack height in an imaging apparatus.

The invention, in one form thereof, is directed to an imaging apparatus. The imaging apparatus includes a print media tray for holding a stack of print media, a controller and a print engine communicatively coupled to the controller. The print engine includes a media detection device mechanically engaged with a stack of print media. The media detection device has a movable indicator having a surface with distinct reflectance characteristics. A reflectance sensor reads a reflectance of the surface, and outputs a signal to the controller indicative of at least one characteristic of the stack of print media.

The invention, in another form thereof, relates to an imaging apparatus including a controller and a media detection device mechanically engaged with a print media. The media detection device has a movable indicator having a surface with distinct reflectance characteristics. A reflectance sensor is communicatively coupled to the controller. The reflectance sensor reads a reflectance of the surface and outputs a signal to the controller indicative of at least one characteristic of the print media.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding aspects throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
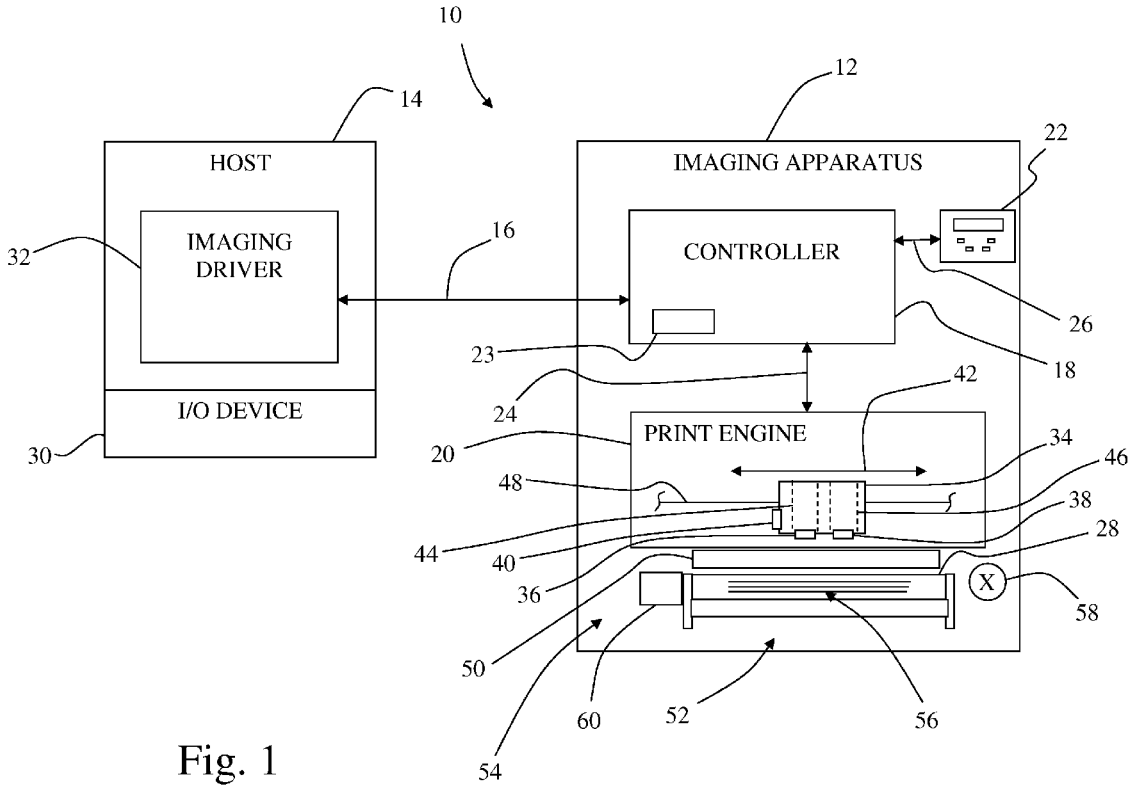
FIG. 1 is a diagrammatic depiction of a system embodying the present invention.

FIG. 1 is a diagrammatic depiction of a system 10 embodying the present invention. System 10 may include an imaging apparatus 12 and a host 14, with imaging apparatus 12 communicating with host 14 via a communications link 16. As used herein, the term "communications link" is used to generally refer to structure that facilitates electronic communication between two components, and may operate using wired or wireless technology.

Alternatively, imaging apparatus 12 may be a standalone unit that is not communicatively linked to a host, such as host 14. For example, imaging apparatus 12 may take the form of a multifunction machine that includes standalone copying and facsimile capabilities, in addition to optionally serving as a printer when attached to a host, such as host 14.

Imaging apparatus 12 includes, for example, a controller 18, a print engine 20 and a user interface 22.

Controller 18 may include a microprocessor and associated memory 23, such as random access memory (RAM) and read only memory (ROM). Controller 18 communicates with print engine 20 via a communications link 24. Controller 18 communicates with user interface 22 via a communications link 26.

Print engine 20 may be, for example, in the form of an electrophotographic print engine, a thermal print engine or an ink jet print engine. In the context of the examples for imaging apparatus 12 given above, print engine 20 is configured for forming an image on a sheet of print media 28. The sheet of print media 28 may be, for example, plain paper, coated paper, photo paper and transparency media.

Host 14 may be, for example, a personal computer including an input/output (I/O) device 30, such as keyboard and display monitor. Host 14 may further include a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 32, e.g., printer driver software, for imaging apparatus 12. Imaging driver 32 is in communication with controller 18 of imaging apparatus 12 via communications link 16. Imaging driver 32 facilitates communication between imaging apparatus 12 and host 14, and may provide formatted print data to imaging apparatus 12, and more particularly, to print engine 20.

Alternatively, however, all or a portion of imaging driver 32 may be located in controller 18 of imaging apparatus 12. For example, where imaging apparatus 12 is a multifunction machine having standalone capabilities, controller 18 of imaging apparatus 12 may include an imaging driver configured to support a copying function, and/or a fax-print function, and may be further configured to support a printer function. In this embodiment, the imaging driver 32 facilitates communication of formatted print data, as determined by a selected print mode, to print engine 20.

Communications link 16 may be established by a direct cable connection, wireless connection or by a network connection such as for example an Ethernet local area network (LAN). Communications links 24 and 26 may be established, for example, by using standard electrical cabling or bus structures, or by wireless connection.

Print engine 20, when in the form of an ink jet print engine, may include, for example, a reciprocating printhead carrier 34, and at least one ink jet printhead, and in this example, includes a printhead 36 and a printhead 38. A reflectance sensor 40 may be mounted to printhead carrier 34. Printhead carrier 34 transports ink jet printheads 36, 38 and reflectance sensor 40 in a reciprocation manner along a bi-directional scan path 42 over an image surface of the sheet of print media 28 during printing and/or sensing operations.

Printhead carrier 34 may be mechanically and electrically configured to mount, carry and facilitate one or more printhead cartridges, such as for example, a monochrome printhead cartridge 44 and/or a color printhead cartridge 46. Each printhead cartridge 44, 46 may include, for example, an ink reservoir containing a supply of ink, to which printheads 36, 38 are respectively attached. Imaging driver 32 may convert data from one data format, such as red, green blue (RGB) data, into data that is compatible with printheads 36, 38, such as cyan, magenta, yellow and black (CMYK) data.

Reflectance sensor 40 may be used, for example, during scanning of a printhead alignment pattern, and thus, sometimes also may be referred to as a printhead alignment sensor. Reflectance sensor 40 may be, for example, a unitary optical sensor including a light source, such as a light emitting diode (LED), and a reflectance detector, such as a phototransistor, with the reflectance detector located on the same side of a media as the light source. The operation of such sensors is well known in the art, and thus, will be discussed herein to the extent necessary to relate the operation of reflectance sensor 40 to the operation of the present invention. For example, the LED of reflectance sensor 40 directs light at a predefined angle onto a reference surface, and at least a portion of light reflected from the surface is received by the reflectance detector of reflectance sensor 40. The intensity of the reflected light received by the reflectance detector varies with the reflectance, i.e., reflectivity, of the reference surface. The light received by the reflectance detector of reflectance sensor 40 is converted to an electrical signal by the reflectance detector of reflectance sensor 40, and supplied to controller 18 for further processing. For example, when performing printhead alignment, the signal generated by the reflectance detector corresponds to the reflectance from the sheet of print media 28 and the reflectance of the printhead alignment pattern, scanned by reflectance sensor 40.

Print engine 20 may further include an encoder strip 48, a feed roller unit 50, a print media tray 52 and a print media detection apparatus 54.

Encoder strip 48 is positioned with respect to printhead carrier 34 to provide feedback to controller 18 of the linear position of printhead carrier 34, in a manner known in the art. For example, encoder strip 48 may be in the form of a plastic or metal ribbon that includes a plurality of parallel openings, which, in conjunction with a reader mounted to printhead carrier 34, provides a series of pulses which are translated by controller 18 into the linear position of printhead carrier 34.

Print media tray 52 is configured to receive a stack of print media 56, from which the sheet of print media 28 is picked and transported to feed roller unit 50, which in turn further transports the sheet of print media 28 during a printing operation. Feed roller unit 50 may include, for example, a feed roller, corresponding index pinch rollers (not shown), and a drive unit. Feed roller unit 50 feeds the sheet of print media 28 in a sheet feed direction 58, designated as an X in a circle to indicate that the sheet feed direction is out of the plane of FIG. 1 toward the reader during printing with printheads 36, 38.

In the embodiment of FIG. 1, print media tray 52 is arranged to hold the stack of print media 56 in a substantially horizontal orientation. In this arrangement, print media tray 52 and feed roller unit 50 are arranged in a configuration defining what is commonly referred to as a C-shaped media path. Alternatively, print media tray 52 may be arranged to hold the print media stack in a substantially vertical orientation. In this arrangement, print media tray 52 and feed roller unit 50 are arranged in a configuration defining what is commonly referred to as a L-shaped media path. The present invention may be easily adapted to operate on imaging apparatus 12, with either a C-shaped media path or an L-shaped media path.

Figure 2:
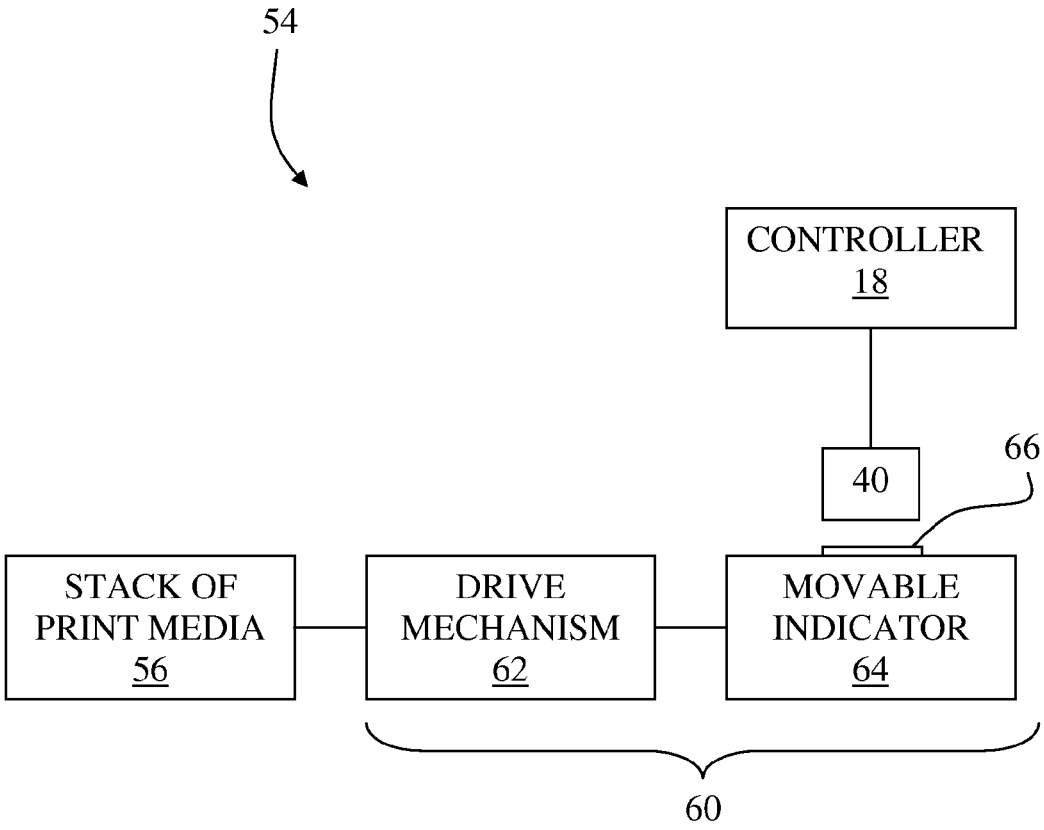
FIG. 2 is a block diagram of a print media detection apparatus, in accordance with the present invention.

FIG. 2 is a block diagram of print media detection apparatus 54. Print media detection apparatus 54 is configured to provide detection of at least one characteristic of the stack of print media 56, such as for example, the print media size, e.g., width or length, and/or the print media stack height in imaging apparatus 12. The stack of print media 56 may be located in print media tray 52. Print media detection apparatus 54 may include a media detection device 60 and a sensor, such as reflectance sensor 40.

Media detection device 60 may be configured to be mechanically engaged with a stack of print media 56, either indirectly via print media tray 52 or directly through direct contact with the stack of print media 56. Media detection device 60 has a drive mechanism 62 and a movable indicator 64 having a surface 66 with distinct reflectance characteristics. Drive mechanism 62 is coupled between the stack of print media 56 and movable indicator 64, wherein movable indicator 64 is moved by drive mechanism 62 based on the measured characteristic(s) of the stack of print media 56, e.g., the print media size and/or print media stack height of the stack of print media 56. Drive mechanism 62 may, for example, be in the form of a linkage drive arrangement or a gear drive arrangement, e.g., a rack and pinion arrangement. Reflectance sensor 40 reads the reflectance of surface 66 of movable indicator 64, and outputs a signal to controller 18 indicative of the measured characteristic(s) of the stack of print media 56. Thus, movable indicator 64 provides a mechanical indication of the print media size and/or print media stack height, and which in turn is translated by the sensor, such as reflectance sensor 40, to a signal that is processed by controller 18 to provide an indication of print media size and/or print media stack height.

Such an indication of print media size and/or print media stack height may be in the form of an electronic indication provided to an application program running on imaging apparatus 12 or host 14, or may be translated into a physical indication that may be displayed, for example, on user interface 22 of imaging apparatus 12 or I/O device 30 of host 14.

FIGS. 3, 4, 5 and 6 show exemplary embodiments of a device suitable for use as movable indicator 64 of media detection device 60.

Figure 3:
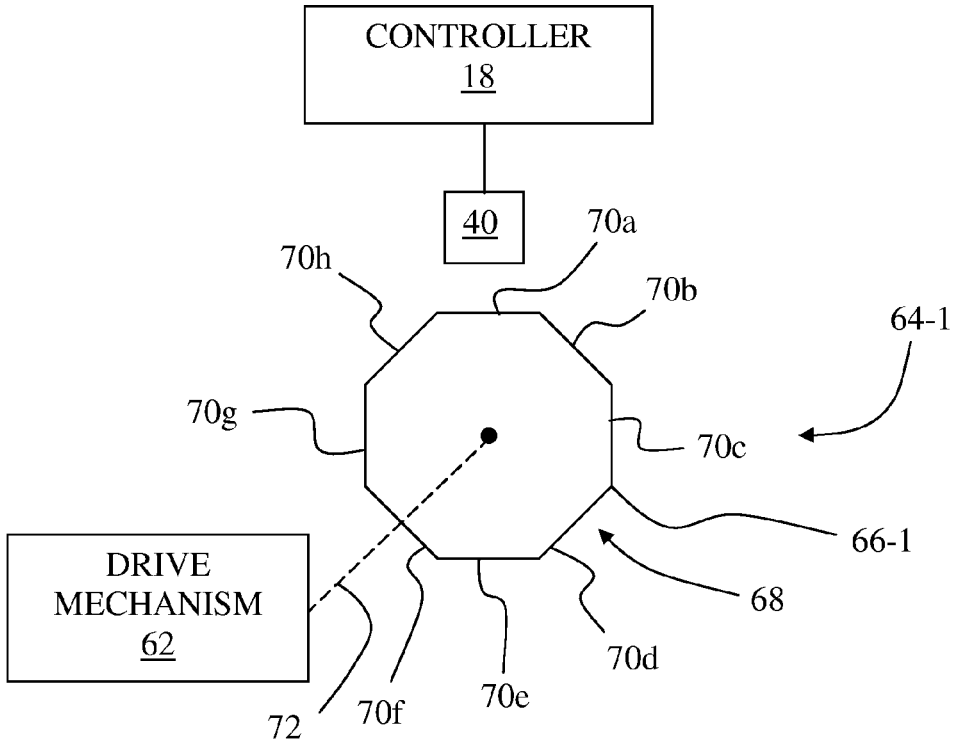
FIG. 3 is a diagrammatic representation of an exemplary embodiment of the movable indicator of FIG. 2 in the form of a multifaceted wheel.
Figure 4:
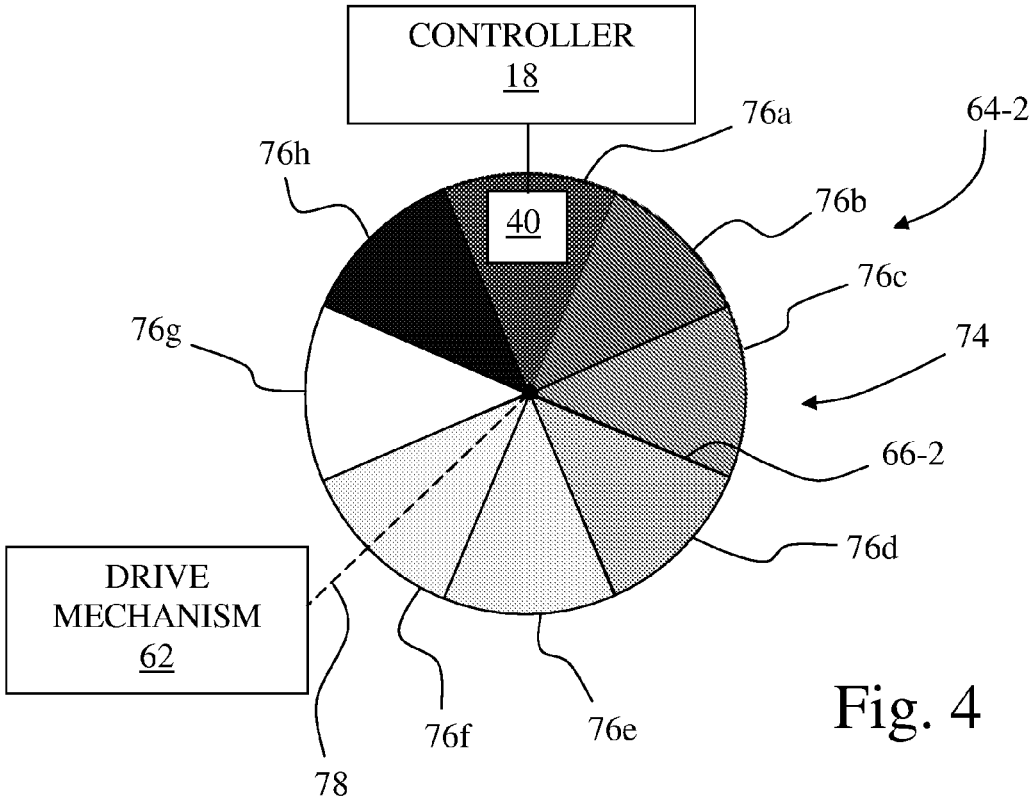
FIG. 4 is a diagrammatic representation of another exemplary embodiment of the movable indicator of FIG. 2 in the form of a sectored wheel.
Figure 5:
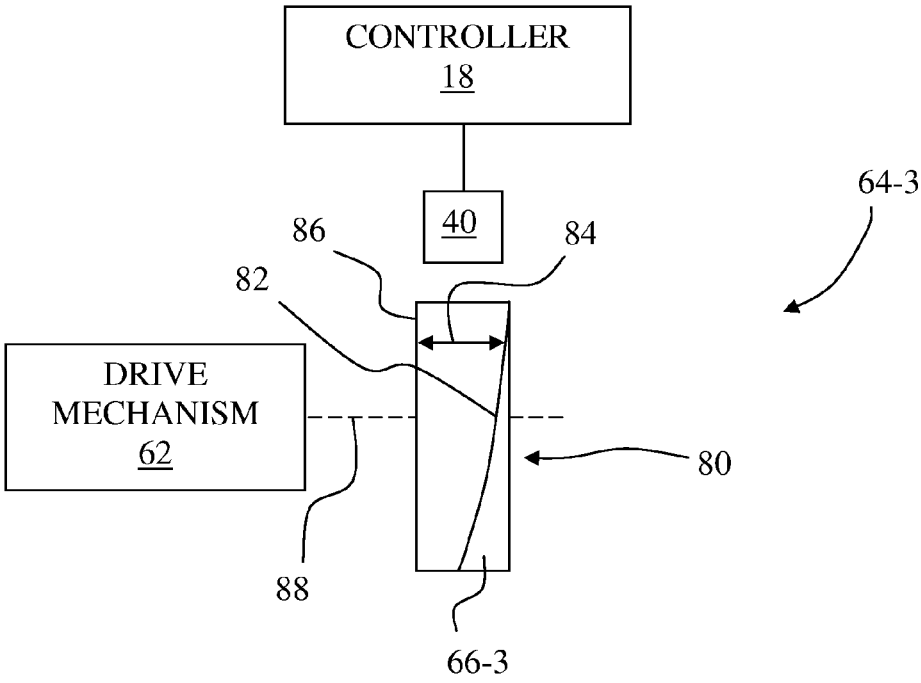
FIG. 5 is a diagrammatic representation of another exemplary embodiment of the movable indicator of FIG. 2 in the form of a wheel having a spiral line indicia.

FIGS. 3-5 show three exemplary embodiments of movable indicator 64 as a wheel having a plurality of reflectance characteristics, and wherein the plurality of reflectance characteristics represent a characteristic of the stack of print media 56, such as for example, the print media size, e.g., width or length, and/or the print media stack height.

FIG. 3 shows an exemplary embodiment 64-1 of movable indicator 64 of FIG. 2 as a multifaceted wheel 68. In this embodiment, multifaceted wheel 68 has a surface 66-1, corresponding to surface 66 of FIG. 2, having eight facets, 70*a*, 70*b*, 70*c*, 70*d*, 70*e*, 70*f*, 70*g*, and 70*h*, wherein at least two facets of multifaceted wheel 68 has different reflectance characteristics, with the different reflectance characteristics respectively representing, for example, different print media sizes, e.g., one of a plurality of print media widths or one of a plurality of print media lengths. By utilizing all facets of multifaceted wheel 68 to have different reflectance characteristics, in the example shown, eight different print media widths may be represented, or eight different print media lengths may be represented.

Alternatively, the facets of multifaceted wheel 68 having different reflectance characteristics may respectively represent a stack height of the stack of print media 56, with each of different reflectance characteristics respectively representing, for example, a general range of stack height, e.g., half-full and empty. By utilizing all facets of multifaceted wheel 68, in the example shown, eight different stack heights may be represented.

Drive mechanism 62 drives multifaceted wheel 68 to rotate about axis 72, such that only one facet of multifaceted wheel 68 is positioned to be read by reflectance sensor 40. Drive mechanism 62 is activated by the characteristic of the stack of print media 56 that is being measured, e.g., print media size or stack height, such that the reflectance of the respective facet of multifaceted wheel 68 represents that particular characteristic of the stack of print media 56.

FIG. 4 shows another exemplary embodiment 64-2 of movable indicator 64 of FIG. 2 as a sectored wheel 74. In this embodiment, sectored wheel 74 has a surface 66-2, corresponding to surface 66 of FIG. 2, having formed thereon eight sectors, 76*a*, 76*b*, 76*c*, 76*d*, 76*e*, 76*f*, 76*g*, and 76*h*, wherein at least two sectors of sectored wheel 74 has different reflectance characteristics, with the different reflectance characteristics respectively representing, for example, different print media sizes, e.g., one of a plurality of print media widths or one of a plurality of print media lengths. By utilizing all sectors of sectored wheel 74 to have different reflectance characteristics, in the example shown, eight different print media widths may be represented, or eight different print media lengths may be represented.

Alternatively, the sectors of sectored wheel 74 having different reflectance characteristics may respectively represent a stack height of the stack of print media 56, with each of different reflectance characteristics respectively representing, for example, a general range of stack height, e.g., half-full and empty. By utilizing all sectors of sectored wheel 74, in the example shown, eight different stack heights may be represented.

Drive mechanism 62 drives sectored wheel 74 to rotate about an axis 78, such that only one sector of sectored wheel 74 is positioned to be read by reflectance sensor 40. Drive mechanism 62 is activated by the characteristic of the stack of print media 56 that is being measured, e.g., print media size or stack height, such that the reflectance of the respective sector of sectored wheel 74 represents that particular characteristic of the stack of print media 56.

FIG. 5 shows another exemplary embodiment 64-3 of movable indicator 64 of FIG. 2 as a wheel 80, wherein wheel 80 has as a parametrical surface 66-3, corresponding to surface 66 of FIG. 2, having a spiral line indicia 82. Parametrical surface 66-3 may be, for example, predominantly highly reflective but for spiral line indicia 82 which is not highly reflective, or vice-versa. The distinct reflectance characteristics provided by wheel 80 is in the form of a varying distance 84 of spiral line indicia 82 from an edge 86 of wheel 80 along parametrical surface 66-3. The distance 84 of spiral line indicia 82 from edge 86 as read by reflectance sensor 40 is related, for example, to different print media sizes, e.g., a plurality of print media widths or a plurality of print media lengths.

Alternatively, the distance 84 of spiral line indicia 82 from edge 86 as read by reflectance sensor 40 may represent a stack height of the stack of print media 56, with the distance 84 representing, for example, a stack height, e.g., a range from full to empty.

Drive mechanism 62 drives wheel 80 to rotate about an axis 88, such that the position of spiral line indicia 82 with respect to edge 86 changes with the rotation of wheel 80, as read by reflectance sensor 40. Drive mechanism 62 is activated by the characteristic of the stack of print media 56 that is being measured, e.g., print media size or stack height, such that the distance 84 of spiral line indicia 82 from edge 86 represents that particular characteristic of the stack of print media 56.

Figure 6:
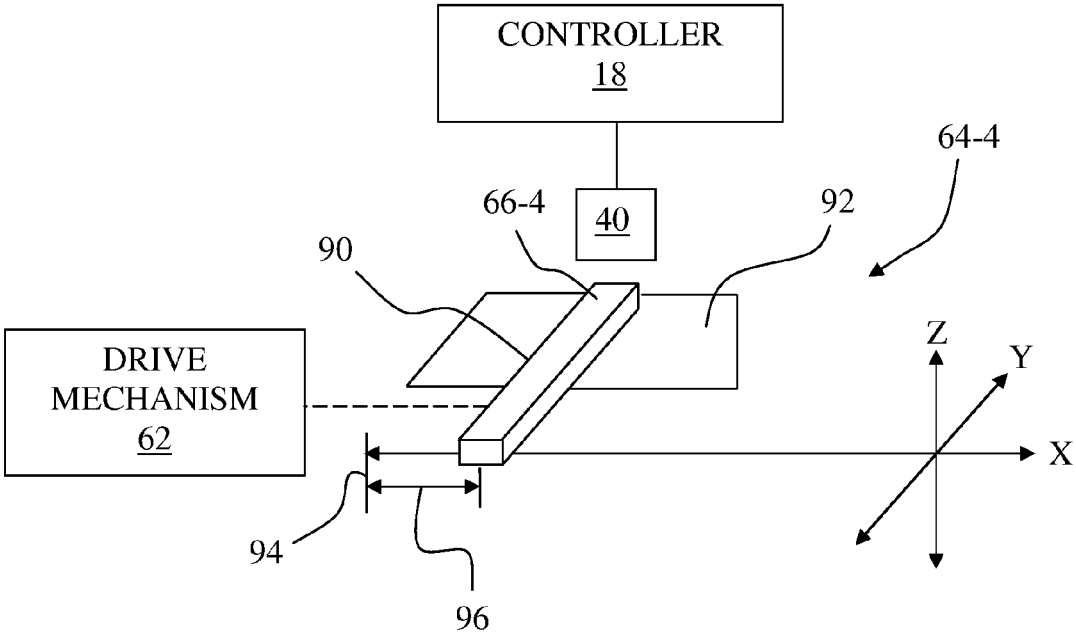
FIG. 6 is a diagrammatic representation of another embodiment of the movable indicator of FIG. 2 in the form of a movable indicator bar.

FIG. 6 shows another exemplary embodiment 64-4 of movable indicator 64 of FIG. 2 as a movable indicator bar 90 having a reflective surface 66-4, corresponding to surface 66 of FIG. 2, that has a reflectance that is in contrast to the reflectance of a background 92, wherein the distinct reflectance characteristics is a varying position of the movable indicator bar 90, such as movement with respect to a reference position 94 by a distance 96 along an X-axis, in this example, based on different print media sizes, e.g., one of a plurality of print media widths or one of a plurality of print media lengths.

Alternatively, the varying position of the movable indicator bar 90, such as movement with respect to reference position 94 by distance 96 along the X-axis, in this example, may represent a stack height of the stack of print media 56, with the distance 96 representing, for example, a stack height, e.g., a range from full to empty.

Drive mechanism 62 drives movable indicator bar 90 to translate in a linear manner along the X-axis, such that reflective surface 66-4 is read by reflectance sensor 40. In this embodiment, reflectance sensor 40 also moves with respect to the X-axis along bi-directional scan path 42. Drive mechanism 62 is activated by the characteristic of the stack of print media 56 that is being measured, e.g., print media size or stack height, such that the distance 96 of movable indicator bar 90 from reference position 94 represents that particular characteristic of the stack of print media 56.

Figure 7:
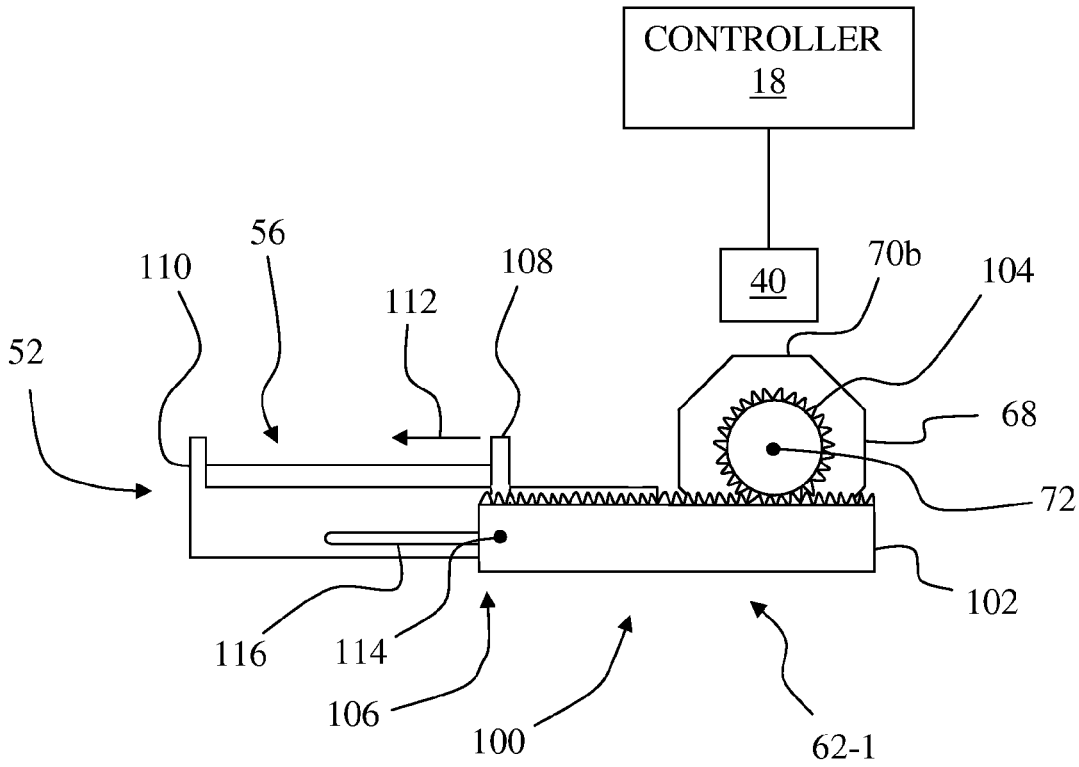
FIG. 7 is a diagrammatic representation of an exemplary embodiment of the drive mechanism of FIG. 2 in the form of a rack and pinion drive.

FIG. 7 shows an exemplary drive arrangement 62-1 corresponding to drive mechanism 62 of FIG. 2, which may be used in determining a media size, e.g., width or length, in print media tray 52. Disposed relative to print media tray 52 in imaging apparatus 12 is a rack and pinion drive 100. Rack and pinion drive 100 includes a rack gear 102 and a pinion gear 104. Attached near a first end 106 of rack gear 102 is a movable media guide 108, which pushes the stack of print media 56 into contact with a fixed media guide 110 when moved in direction 112. Movable media guide 108 may be attached to rack gear 102, for example, by a connecting pin 114 that rides in a slot 116 formed in the side of print media tray 52. Pinion gear 104, in mesh with rack gear 102, is attached to a wheel, such as multifaceted wheel 68 in this example.

When movable media guide 108 is moved in direction 112, rack gear 102 also moves in direction 112, and as a result, pinion gear 104 is rotated, which in turn causes a rotation of multifaceted wheel 68 around axis 72.

Accordingly, a particular facet, e.g., facet 70*b* in this example, is positioned to face reflectance sensor 40. Reflectance sensor 40 reads facet 70*b*, and sends a corresponding signal to controller 18, which in turn correlates the signal representing the reflectance of facet 70*b* to a particular media size, e.g., a particular print media width or a particular print media length.

Those skilled in that art will recognize that this exemplary embodiment that includes multifaceted wheel 68 could be modified to include the arrangement of FIG. 4, which includes sectored wheel 74, or the arrangement of FIG. 5, which includes wheel 80 having spiral line indicia 82.

Figure 8:
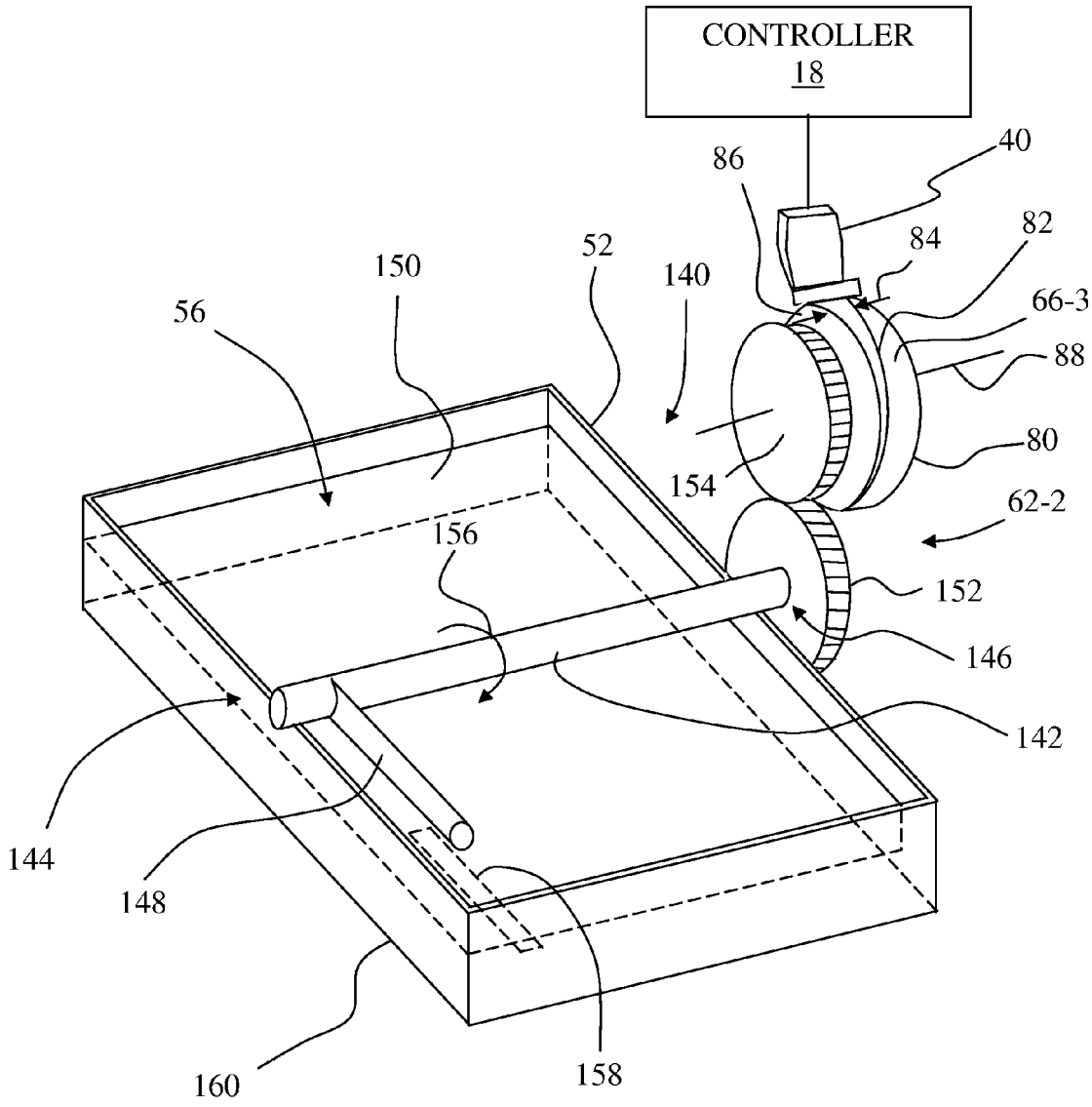
FIG. 8 is a diagrammatic representation of another exemplary embodiment of the drive mechanism of FIG. 2 in the form of a linkage drive.

FIG. 8 shows an exemplary drive arrangement 62-2 corresponding to drive mechanism 62 of FIG. 2, which may be used in determining a stack height in print media tray 52. Disposed above print media tray 52 in imaging apparatus 12 is a linkage drive 140. Linkage drive 140 includes a pivot rod 142 having a first end 144 and a second end 146. Attached to pivot rod 142 near first end 144 is a contact arm 148 which is positioned to remain in contact with a top sheet 150 of the stack of print media 56. Attached to second end 146 of pivot rod 142 is a drive gear 152. A driven gear 154, in mesh with drive gear 152, is attached to a wheel, such as wheel 80 in this example. As the print media is depleted from the stack of print media 56, pivot rod 142 pivots in rotation direction 156. In turn, wheel 80 is rotated via gears, 152, 154. As wheel 80 rotates, the distance 84 of spiral line indicia 82 from edge 86 as read by reflectance sensor 40 changes, thereby representing the print media stack height of the stack of print media 56 in print media tray 52.

For example, when reflectance sensor 40 is scanned via printhead carrier 34 from left to right, in the embodiment shown, reflectance sensor 40 will first encounter the high reflective surface of parametrical surface 66-3, and then the low reflectance of spiral line indicia 82, at which time, based on the position of reflectance sensor 40 as indicated by the feedback provided by encoder strip 48 (see FIG. 1), controller 18 can make a determination of the position of spiral line indicia 82 at the point of detection, and translate that position, e.g., distance 84, into a stack height of the stack of print media 56. Alternatively, the absolute position of printhead carrier 34, e.g., distance from a carrier home position, at the time of detection, may be used in determining the position of spiral line indicia 82 at the point of detection by reflectance sensor 40, and thus the stack height of the stack of print media 56.

When all of the print media is depleted from the stack of print media 56, then contact arm 148 abruptly falls through a slot 158 in floor 160 of print media tray 52. As a result, wheel 80 makes an abrupt rotation, thereby indicating to controller 18 via reflectance sensor 40 that print media tray 52 is empty.

Those skilled in that art will recognize that this exemplary embodiment that includes wheel 80 could be modified to include the arrangement of FIG. 3, which includes multifaceted wheel 68, or the arrangement of FIG. 4, which includes sectored wheel 74.

Figure 9:
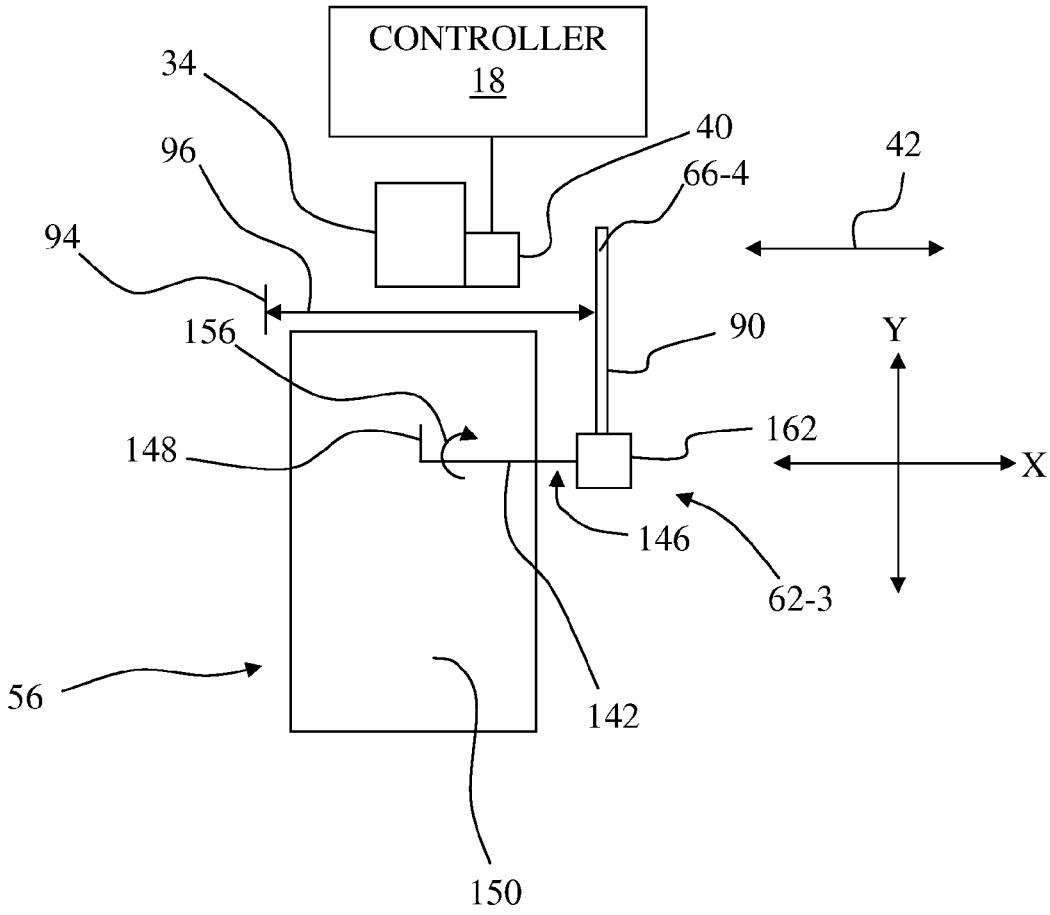
FIG. 9 is a diagrammatic representation of still another exemplary embodiment of the drive mechanism of FIG. 2 in the form of mechanical module changing rotational motion to linear motion.

FIG. 9 is a diagrammatic depiction of another drive arrangement 62-3 corresponding to drive mechanism 62 of FIG. 2, viewed from the top, which may be used in determining a stack height in print media tray 52 when using movable indicator bar 90 as movable indicator 64. This embodiment includes pivot rod 142 and contact arm 148 from the embodiment described in FIG. 8, and further includes a mechanical module 162. Second end 146 of pivot rod 142 is coupled to mechanical module 162 to pivot about the X-axis in rotation direction 156. Mechanical module 162 then converts the rotational motion of pivot rod 142 into a linear motion of reflective surface 66-4 of movable indicator bar 90 along the X-axis (see also FIG. 6). Thus, as the print media stack height of the stack of print media 56 changes, so does the position of movable indicator bar 90 along the X-axis.

For example, with reference to FIGS. 1, 6 and 9, when reflectance sensor 40 is scanned via printhead carrier 34 from left to right along scan path 42, in the embodiment shown, reflectance sensor 40 will encounter the high reflectivity of reflective surface 66-4 of movable indicator bar 90. Based on the linear position of reflectance sensor 40 relative to reference position 94 provided by encoder strip 48, controller 18 can make a determination of the position of movable indicator bar 90 relative to reference position 94, such as a carrier home position, and translate the position of movable indicator bar 90, as represented by distance 96, into a stack height of the stack of print media 56.

While this invention has been described with respect to exemplary embodiments of the present invention, those skilled in the art will recognize that the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a print media tray for holding a stack of print media;

a controller; and a print engine communicatively coupled to said controller, said print engine including:

a media detection device mechanically engaged with said stack of print media, said media detection device having a movable indicator having a surface with distinct reflectance characteristics, said moveable indicator being attached to said imaging apparatus; and a reflectance sensor for reading a reflectance of said surface, and outputting a signal to said controller indicative of at least one characteristic of said stack of print media;

wherein said at least one characteristic of said stack of print media is a print media size, and wherein said media detection device comprises:

a wheel having a plurality of reflectance characteristics, said plurality of reflectance characteristics representing different print media sizes; and a drive mechanism coupled between said stack of print media and said wheel, wherein said wheel is rotated by said drive mechanism based on said print media size of said stack of print media, said reflectance sensor reading a particular location on said wheel corresponding to said print media size of said stack of print media.

2. The imaging apparatus of claim 1, wherein said wheel is a multifaceted wheel, wherein at least two facets of said multifaceted wheel have different reflectance characteristics, said different reflectance characteristics respectively representing different print media sizes.

3. The imaging apparatus of claim 1, wherein said surface has a plurality of sectors formed on said wheel, wherein at least two sectors of said plurality of sectors has different reflectance characteristics, said different reflectance characteristics respectively representing different print media sizes.

4. The imaging apparatus of claim 1, wherein said surface is a parametrical surface of said wheel having a spiral line indicia, wherein said distinct reflectance characteristics is a varying distance of said spiral line indicia from an edge of said wheel along said parametrical surface of said wheel, and wherein said distance of said spiral line indicia from said edge as read by said reflectance sensor is related to different print media sizes.

5. The imaging apparatus of claim 1, wherein said print media size is a width of a sheet of print media in said stack of print media.

6. The imaging apparatus of claim 1, wherein said print media size is a length of a sheet of print media in said stack of print media.

7. The imaging apparatus of claim 1, wherein said drive mechanism is a linkage drive having a first end and a second end, said first end having a contact arm engaging said stack of print media, said second end being coupled to said wheel.

8. The imaging apparatus of claim 1, wherein said drive mechanism is a rack and pinion drive having a rack gear and a pinion gear, said rack gear being coupled to a movable media guide on said print media tray, said pinion gear being coupled to said wheel.

9. The imaging apparatus of claim 1, further comprising a carrier, said reflectance detector sensor being mounted to said carrier for movement along a scan path.

10. The imaging apparatus of claim 9, further comprising an encoder strip providing an indication of a linear position of said reflectance detector sensor along said scan path, said controller determining said at least one characteristic of said stack of print media based on a location along said scan path where said reflectance sensor detects said surface of said movable indicator.

11. The imaging apparatus of claim 10, wherein said movable indicator is a spiral line indicia formed on a parametrical surface of a wheel, wherein said distinct reflectance characteristics is a varying distance of said spiral line indicia from an edge of said wheel along said parametrical surface of said wheel, and wherein said distance of said spiral line from said edge as read by said reflectance sensor is related to different print media sizes.

12. The imaging apparatus of claim 10, wherein said movable indicator is a movable bar having a reflective surface wherein said distinct reflectance characteristics is a varying position of said movable bar based on a print media size of said stack of print media in relation to a background reflectivity.

13. The imaging apparatus of claim 10, wherein said linear position along said scan path is with respect to a reference position.

14. The imaging apparatus of claim 13, wherein said reference position is a home position of said carrier.

15. An imaging apparatus, comprising:

a controller; and a media detection device mechanically engaged with said stack of print media, said media detection device having a movable indicator having a surface with distinct reflectance characteristics, said moveable indicator being attached to said imaging apparatus; and a reflectance sensor for reading a reflectance of said surface, and outputting a signal to said controller indicative of at least one characteristic of said stack of print media;

wherein said at least one characteristic of said stack of print media is a print media size, and wherein said media detection device comprises:

a wheel having a plurality of reflectance characteristics, said plurality of reflectance characteristics representing different print media sizes; and a drive mechanism coupled between said stack of print media and said wheel, wherein said wheel is rotated by said drive mechanism based on said print media size of said stack of print media, said reflectance sensor reading a particular location on said wheel corresponding to said print media size of said stack of print media.

16. The imaging apparatus of claim 15, wherein said wheel is a multifaceted wheel, wherein at least two facets of said multifaceted wheel has different reflectance characteristics, said different reflectance characteristics respectively representing different print media sizes.

17. The imaging apparatus of claim 15, wherein said surface has a plurality of sectors formed on said wheel, wherein at least two sectors of said plurality of sectors has different reflectance characteristics, said different reflectance characteristics respectively representing different print media sizes.

18. The imaging apparatus of claim 15, wherein said surface is a parametrical surface of said wheel having a spiral line indicia, wherein said distinct reflectance characteristics is a varying distance of said spiral line indicia from an edge of said wheel along said parametrical surface of said wheel, and wherein said distance of said spiral line indicia from said edge as read by said reflectance sensor is related to different print media sizes.

19. The imaging apparatus of claim 15, wherein said print media size is a width of a sheet of said print media.

20. The imaging apparatus of claim 15, wherein said print media size is a length of a sheet of said print media.

21. The imaging apparatus of claim 15, wherein said drive mechanism is a linkage drive having a first end and a second end, said first end having a contact arm engaging said print media, said second end being coupled to said wheel.

22. The imaging apparatus of claim 15, wherein said drive mechanism is a rack and pinion drive having a rack gear and a pinion gear, said rack gear being coupled to a movable media guide on a print media tray, said pinion gear being coupled to said wheel.

23. The imaging apparatus of claim 15, further comprising a carrier, said reflectance detector sensor being mounted to said carrier for movement along a scan path.

24. The imaging apparatus of claim 23, further comprising an encoder strip providing an indication of a linear position of said reflectance detector sensor along said scan path, said controller determining said at least one characteristic of said print media based on a location along said scan path where said reflectance sensor detects said surface of said movable indicator.

25. The imaging apparatus of claim 24, wherein said movable indicator is a spiral line indicia formed on a parametrical surface of a wheel, wherein said distinct reflectance characteristics is a varying distance of said spiral line indicia from an edge of said wheel along said parametrical surface of said wheel, and wherein said distance of said spiral line from said edge as read by said reflectance sensor is related to different print media sizes.

26. The imaging apparatus of claim 24, wherein said movable indicator is a movable bar having a reflective surface, wherein said distinct reflectance characteristics is a varying position of said movable bar based on a print media size of said print media in relation to a background reflectivity.

27. The imaging apparatus of claim 24, wherein said linear position along said scan path is with respect to a reference position.

28. The imaging apparatus of claim 27, wherein said reference position is a home position of said carrier.

29. An imaging apparatus, comprising:

a print media tray for holding a stack of print media;

a controller; and a print engine communicatively coupled to said controller, said print engine including: a media detection device mechanically engaged with said stack of print media, said media detection device having:

a movable multifaceted wheel having at least two facets, said at least two facets having different reflectance characteristics, said different reflectance characteristics respectively representing different print media sizes; and a drive mechanism coupled between said stack of print media and said multifaceted wheel;

and a reflectance sensor for reading a reflectance of one of said at least two facets, and outputting a signal to said controller indicative of a print media size of said stack of print media;

wherein said moveable multifaceted wheel is rotated by said drive mechanism based on said print media size of said stack of print media, said reflectance sensor reading a particular location on said moveable multifaceted wheel corresponding to said print media size of said stack of print media.

30. An imaging apparatus, comprising:

a print media tray for holding a stack of print media, said print media tray having a movable media guide;

a controller; and a print engine communicatively coupled to said controller, said print engine including: a media detection device mechanically engaged with said stack of print media, said media detection device having:

a moveable wheel having a surface having plurality of reflectance characteristics, said plurality of reflectance characteristics representing different print media sizes; and a drive mechanism coupled between said stack of print media and said moveable wheel, said drive mechanism including a rack and pinion drive having a rack gear and a pinion gear, said rack gear being coupled to said movable media guide on said print media tray, said pinion gear being coupled to said moveable wheel; and a reflectance sensor for reading a reflectance of said movable wheel and outputting a signal to said controller indicative of a print media size of said stack of print media;

wherein said moveable wheel is rotated by said drive mechanism based on said print media size of said stack of print media, said reflectance sensor reading a particular location on said moveable wheel corresponding to said print media size of said stack of print media.

31. An imaging apparatus, comprising:

a print media tray for holding a stack of print media;

a controller; and a print engine communicatively coupled to said controller, said print engine including:

a media detection device mechanically engaged with said stack of print media, said media detection device having a movable bar having a reflective surface with distinct reflectance characteristics wherein said distinct reflectance characteristics is a varying position of said movable bar based on a print media size of said stack of print media in relation to a background reflectivity;

a reflectance sensor for reading a reflectance of said surface, and outputting a signal to said controller indicative of said print media size of said stack of print media;

a carrier, said reflectance sensor being mounted to said carrier for movement along a scan path; and an encoder strip providing an indication of a linear position of said reflectance sensor along said scan path, said controller determining said print media size of said stack of print media based on a location along said scan path where said reflectance sensor detects said surface of said movable indicator.

32. An imaging apparatus, comprising:

a controller;

a media detection device mechanically engaged with a stack of print media, said media detection device having:

a movable multifaceted wheel having at least two facets having different reflectance characteristics, said different reflectance characteristics representing different print media sizes indicator; and a drive mechanism coupled between said print media and said wheel;

and a reflectance sensor communicatively coupled to said controller, said reflectance sensor reading a reflectance of said moveable multifaceted wheel and outputting a signal to said controller indicative of a print media size of said stack of print media, wherein said moveable multifaceted wheel is rotated by said drive mechanism based on said print media size of said stack of print media, said reflectance sensor reading a particular location on said moveable multifaceted wheel corresponding to said print media size of said stack of print media.

33. An imaging apparatus, comprising:

a print media tray for holding a stack of print media, said print media tray having movable media guide;

a controller;

a media detection device mechanically engaged with said stack of print media, said media detection device having:

a movable wheel having a plurality of reflectance characteristics, said plurality of reflectance characteristics representing different print media sizes; and a drive mechanism coupled between said print media and said moveable wheel, said drive mechanism including a rack and pinion drive having a rack gear and a pinion gear, said rack gear being coupled to said movable media guide on a print media tray, said pinion gear being coupled to said wheel;

a reflectance sensor communicatively coupled to said controller, said reflectance sensor reading a reflectance of said moveable wheel and outputting a signal to said controller indicative of a print media size of said stack of print media;

wherein said moveable wheel is rotated by said drive mechanism based on said print media size of said stack of print media, said reflectance sensor reading a particular location on said moveable wheel corresponding to said print media size of said stack of print media.

34. An imaging apparatus, comprising:

a controller;

a media detection device mechanically engaged with a stack of print media, said media detection device having a movable bar having a reflective surface with distinct reflectance characteristics, wherein said distinct reflectance characteristics is a varying position of said movable bar based on a print media size of said stack of print media in relation to a background reflectivity; and a reflectance sensor communicatively coupled to said controller, said reflectance sensor reading a reflectance of said surface and outputting a signal to said controller indicative of said print media size of said stack of print media;

a carrier, said reflectance sensor being mounted to said carrier for movement along a scan path; and an encoder strip providing an indication of a linear position of said reflectance sensor along said scan path, said controller determining said print media size of said print media based on a location along said scan path where said reflectance sensor detects said surface of said movable indicator.

* * * * *